US009134014B2

(12) United States Patent
Lyu et al.

(10) Patent No.: US 9,134,014 B2
(45) Date of Patent: Sep. 15, 2015

(54) RECESSED LAMP HOUSING WITH ADJUSTABLE SPRING CLIPPING DEVICE

(71) Applicants: Li-Ciang Lyu, New Taipei (TW); Chung Jung Chen, New Taipei (JP)

(72) Inventors: Li-Ciang Lyu, New Taipei (TW); Chung Jung Chen, New Taipei (JP)

(73) Assignee: Everlight Electonics Co., Ltd. (TW)

( * ) Notice: Subject to any disclaimer, the term of this patent is extended or adjusted under 35 U.S.C. 154(b) by 292 days.

(21) Appl. No.: 13/650,450

(22) Filed: Oct. 12, 2012

(65) Prior Publication Data

US 2013/0272001 A1 Oct. 17, 2013

Related U.S. Application Data

(60) Provisional application No. 61/623,848, filed on Apr. 13, 2012.

(51) Int. Cl.
*F21V 21/04* (2006.01)
*F21S 8/02* (2006.01)

(52) U.S. Cl.
CPC ..... *F21V 21/04* (2013.01); *F21S 8/026* (2013.01); *F21V 21/049* (2013.01)

(58) Field of Classification Search
None
See application file for complete search history.

(56) References Cited

U.S. PATENT DOCUMENTS

| | | | | |
|---|---|---|---|---|
| 7,588,351 | B2 * | 9/2009 | Meyer | 362/294 |
| 2011/0103068 | A1 * | 5/2011 | Park et al. | 362/297 |

FOREIGN PATENT DOCUMENTS

| | | |
|---|---|---|
| JP | 54-120984 | 9/1979 |
| JP | 06-223609 | 8/1994 |
| TW | 198400 | 1/1993 |
| TW | 568237 | 12/2003 |
| TW | M248966 | 11/2004 |
| TW | 201128117 | 8/2011 |

* cited by examiner

*Primary Examiner* — Ashok Patel
(74) *Attorney, Agent, or Firm* — Han IP Corporation

(57) ABSTRACT

A downlight that can be easily installed into and dismounted from a ceiling is provided. The housing of the downlight includes an adjustable spring clipping device. Utilization of the adjustable spring clipping device saves a user from having to spend much effort on installation or dismounting of the downlight, and allows installation and dismounting of the downlight to be easily and conveniently performed.

5 Claims, 9 Drawing Sheets

(A)

100

(B)

100

(C)

100

RECESSED LAMP HOUSING WITH ADJUSTABLE SPRING CLIPPING DEVICE

CROSS-REFERENCE TO RELATED APPLICATIONS

This application claims the priority benefit of U.S. Patent Application No. 61/623,848, filed on Apr. 13, 2012, the entirety of which is hereby incorporated by reference.

BACKGROUND

1. Technical Field

The present invention relates to lighting devices and, more particularly, to a downlight having a housing with an adjustable spring clipping device.

2. Description of Related Art

Downlights, also known as recessed lights, are light fixtures installed into a hollow opening in a ceiling. Existing downlights tend to have a number of disadvantages in terms of installation. First, for those downlights that are installed from above the ceiling board, it is usually necessary to drill holes next to the area where the downlight is to be installed and then cover up the holes with a board. Not only is it difficult to install but the aesthetics of the interior décor may also be impacted. Second, for those downlights that are installed from below the ceiling board, the downlights are typically force-inserted into a recess in the ceiling using a spring piece. However, dismounting such downlights usually requires a tremendous amount of force, not to mention the potential of damaging the ceiling board or the downlight itself.

SUMMARY

The present invention provides a downlight that can be easily installed into and dismounted from a ceiling by utilizing an adjustable spring clipping device. This saves a user from having to spend much effort on installation or dismounting of the downlight, and allows installation and dismounting of the downlight to be easily and conveniently performed.

According to one aspect, a housing of a downlight may comprise a first cover, a first spring clipping piece, and a second spring clipping piece. The first cover may include a primary surface surrounded by a plurality of sidewalls forming a cavity therewithin that is configured to receive a light source. A first sidewall of the plurality of sidewalls may include at least one opening. A second sidewall of the plurality of sidewalls may include at least one opening. The first spring clipping piece may be disposed on an exterior surface of the first sidewall of the first cover. The first spring clipping piece may include at least one movable portion that traverses through the at least one opening of the first sidewall, the movable portion of the first spring clipping piece configured to be pulled inwardly with respect to the housing through the at least one opening of the first sidewall. The second spring clipping piece may be disposed on an exterior surface of the second sidewall of the first cover. The second spring clipping piece may include at least one movable portion that traverses through the at least one opening of the second sidewall, the movable portion of the second spring clipping piece configured to be pulled inwardly with respect to the housing through the at least one opening of the second sidewall.

In at least some embodiments, a height of the first spring clipping piece with respect to the primary surface of the first cover may be adjustable.

In at least some embodiments, the first spring clipping piece may be fastened to the first cover by at least one screw.

In at least some embodiments, a height of the second spring clipping piece with respect to the primary surface of the first cover may be adjustable.

In at least some embodiments, the housing of a downlight may further comprise a second cover having an opening. The second cover may be mechanically coupled to the first cover.

According to another aspect, a downlight may comprise a light source, a first cover, a first spring clipping piece, and a second spring clipping piece. The first cover may include a primary surface surrounded by a plurality of sidewalls forming a cavity therewithin that is configured to receive a light source. A first sidewall of the plurality of sidewalls may include at least one opening. A second sidewall of the plurality of sidewalls may include at least one opening. The first spring clipping piece may be disposed on an exterior surface of the first sidewall of the first cover. The first spring clipping piece may include at least one movable portion that traverses through the at least one opening of the first sidewall such that, when the movable portion is pulled inwardly with respect to the housing, the first spring clipping piece extends less from the exterior surface of the first sidewall. The second spring clipping piece may be disposed on an exterior surface of the second sidewall of the first cover. The second spring clipping piece may include at least one movable portion that traverses through the at least one opening of the second sidewall such that, when the movable portion is pulled inwardly with respect to the housing, the second spring clipping piece extends less from the exterior surface of the second sidewall.

In at least some embodiments, a height of the first spring clipping piece with respect to the primary surface of the first cover may be adjustable.

In at least some embodiments, the first spring clipping piece may be fastened to the first cover by at least one screw.

In at least some embodiments, a height of the second spring clipping piece with respect to the primary surface of the first cover may be adjustable.

In at least some embodiments, the housing of a downlight may further comprise a second cover having an opening. The second cover may be mechanically coupled to the first cover.

In at least some embodiments, the light source may comprise a light emitting diode (LED).

According to another aspect, a downlight may comprise a light source, a cover, and a spring clipping piece. The cover may include a sidewall and a cavity configured to receive the light source. The sidewall may include an opening. The spring clipping piece may comprise a fixing piece disposed on an exterior surface of the sidewall, a movable portion that traverses through the opening of the sidewall, and a cantilever piece coupled between the fixing piece and the movable portion. The cantilever piece may protrude outwardly from the fixing piece in a natural status. The cantilever may be swung toward the exterior surface of the sidewall in a motion status when the movable piece is pressed.

In at least some embodiments, the spring clipping piece may be adjustably movable with respect to the sidewall of the first cover.

In at least some embodiments, the spring clipping piece may be fastened to the cover by at least one screw.

In at least some embodiments, the downlight may further comprise a second cover having an opening, and the second cover may be mechanically coupled to the cover.

In at least some embodiments, the light source comprises a light emitting diode (LED).

According to another aspect, a housing of a downlight may comprise a cover and a spring clipping piece. The cover may include a surface and a wall. The surface and the wall may form a cavity therewithin. The wall may include an opening. The spring clipping piece may be disposed on an exterior surface of the wall. The spring clipping piece may include a protruding portion that extends away from the exterior surface and a movable portion that traverses through the opening of the wall such that, the protruding portion of the spring clipping piece extends less from the exterior surface of the wall when pressure is applied onto the movable portion.

In at least some embodiments, the spring clipping piece may be adjustably movable with respect to the wall of the cover.

In at least some embodiments, the spring clipping piece may be fastened to the cover by at least one screw.

In at least some embodiments, the housing of the downlight may further comprise a second cover having an opening. The second cover may be mechanically coupled to the cover.

BRIEF DESCRIPTION OF THE DRAWINGS

Detailed description of the present invention is provided below with reference to the following figures.

DETAILED DESCRIPTION OF DISCLOSED EMBODIMENTS

Figure 1A:
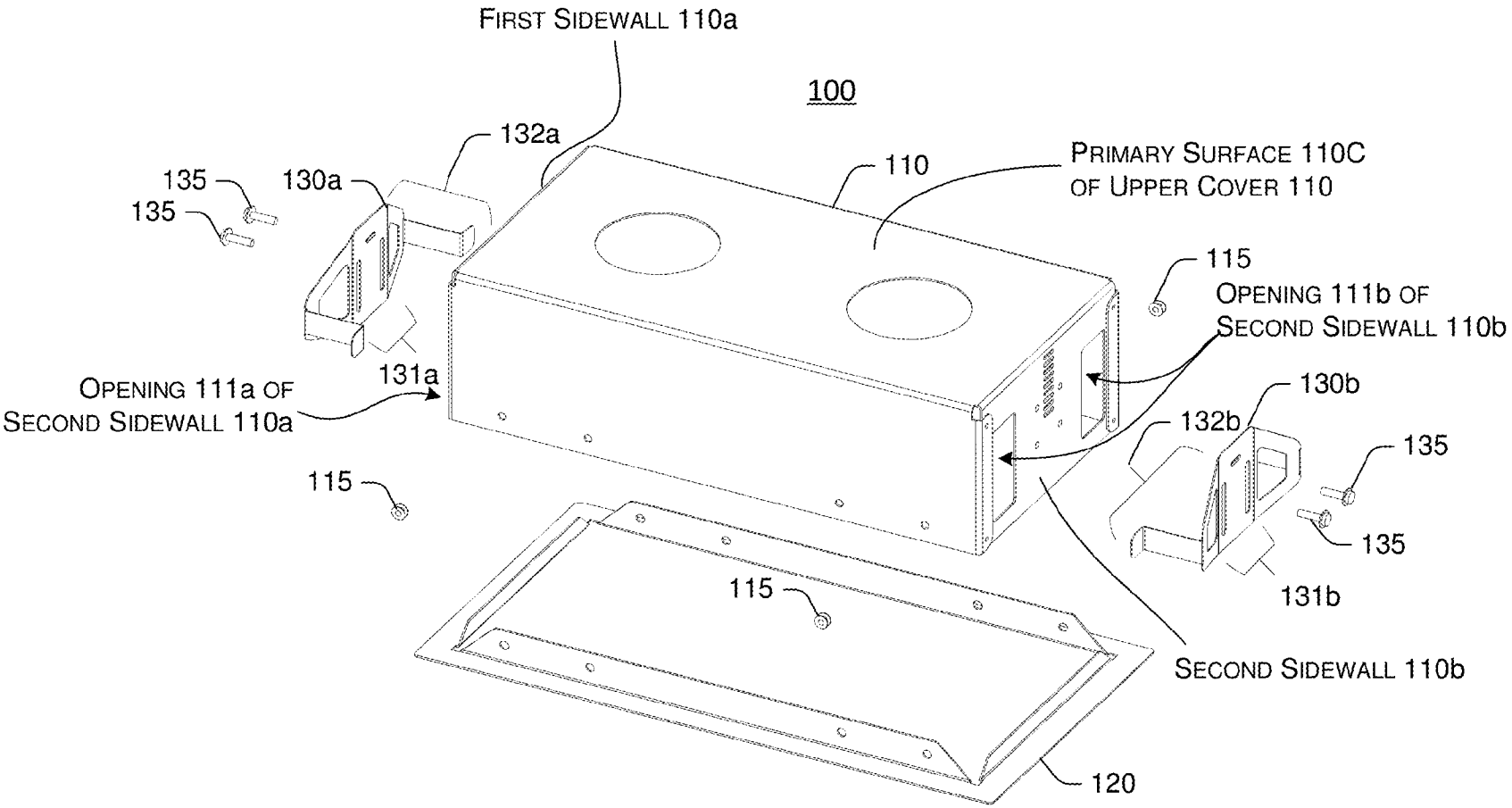
FIG. 1A is a three-dimensional exploded view of a housing of a downlight with an adjustable spring clipping device in accordance with an embodiment of the present invention.
Figure 1B:
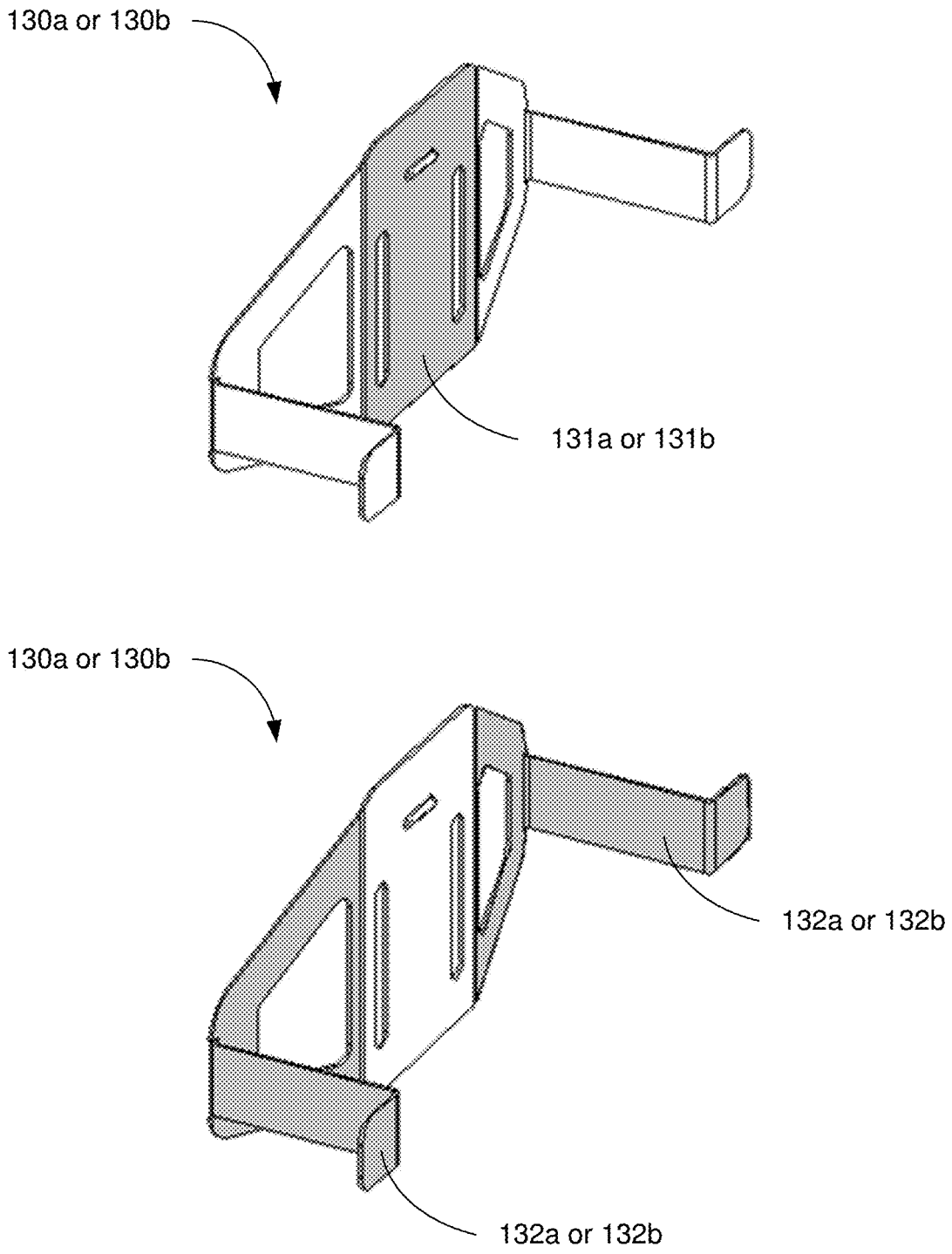
FIG. 1B is a close-up view of a spring clipping piece of FIG. 1A.

FIG. 1A is a three-dimensional exploded view of a housing 100 of a downlight with an adjustable spring clipping device in accordance with an embodiment of the present invention. FIG. 1B is a close-up view of a spring clipping piece of FIG. 1A.

As shown in FIG. 1A, the housing 100 comprises an upper cover 110, a spring clipping device that includes a first spring clipping piece 130*a* and a second spring clipping piece 130*b*, a plurality of screws 135, and a plurality of rivets 115. The upper cover 110 includes a primary surface 110*c* surrounded by a plurality of sidewalls, including first sidewall 110*a* and second sidewall 110*b*. The screws 135 fasten the first and second spring clipping pieces 130*a*, 130*b* to the upper housing 100. That is, each of the first and second spring clipping pieces 130*a*, 130*b* is disposed on an exterior surface of a respective sidewall of the upper cover 110, namely first sidewall 110*a* and second sidewall 110*b*. The rivets 115 fasten or otherwise affix the lower cover 120 to the upper cover 110 so that the lower cover 120 is mechanically coupled to the upper cover 110. Each of the first and second spring clipping pieces 130*a*, 130*b* includes at least one movable portion 132*a*, 132*b*, respectively, each of which traverses through a respective opening 111*a*, 111*b* on the respective sidewall 110*a*, 110*b* of the upper cover 110, respectively. Each of the first and second spring clipping pieces 130*a*, 130*b* also includes an adjustable portion 131*a*, 131*b*, respectively. When the respective at least one movable portion 132*a*, 132*b* of each of the first and second spring clipping pieces 130*a*, 130*b* is pulled inwardly with respect to the upper cover 110 so that the first and second spring clipping pieces 130*a*, 130*b* extend less or minimally from the exterior surface of the respective sidewall 110*a*, 110*b* of the upper cover 110, the housing 100 can snugly slide in and out of a cutout on a ceiling board for installation or dismounting of the housing 100. During installation, after the respective at least one movable portion 132*a*, 132*b* of each of the first and second spring clipping pieces 130*a*, 130*b* is released, the at least one movable portion 132*a*, 132*b* springs back so that the first and second spring clipping pieces 130*a*, 130*b* extend away from the respective side wall 110*a*, 110*b* of the upper cover 110, the housing 100 is embedded in the recess in the ceiling.

Figure 2:
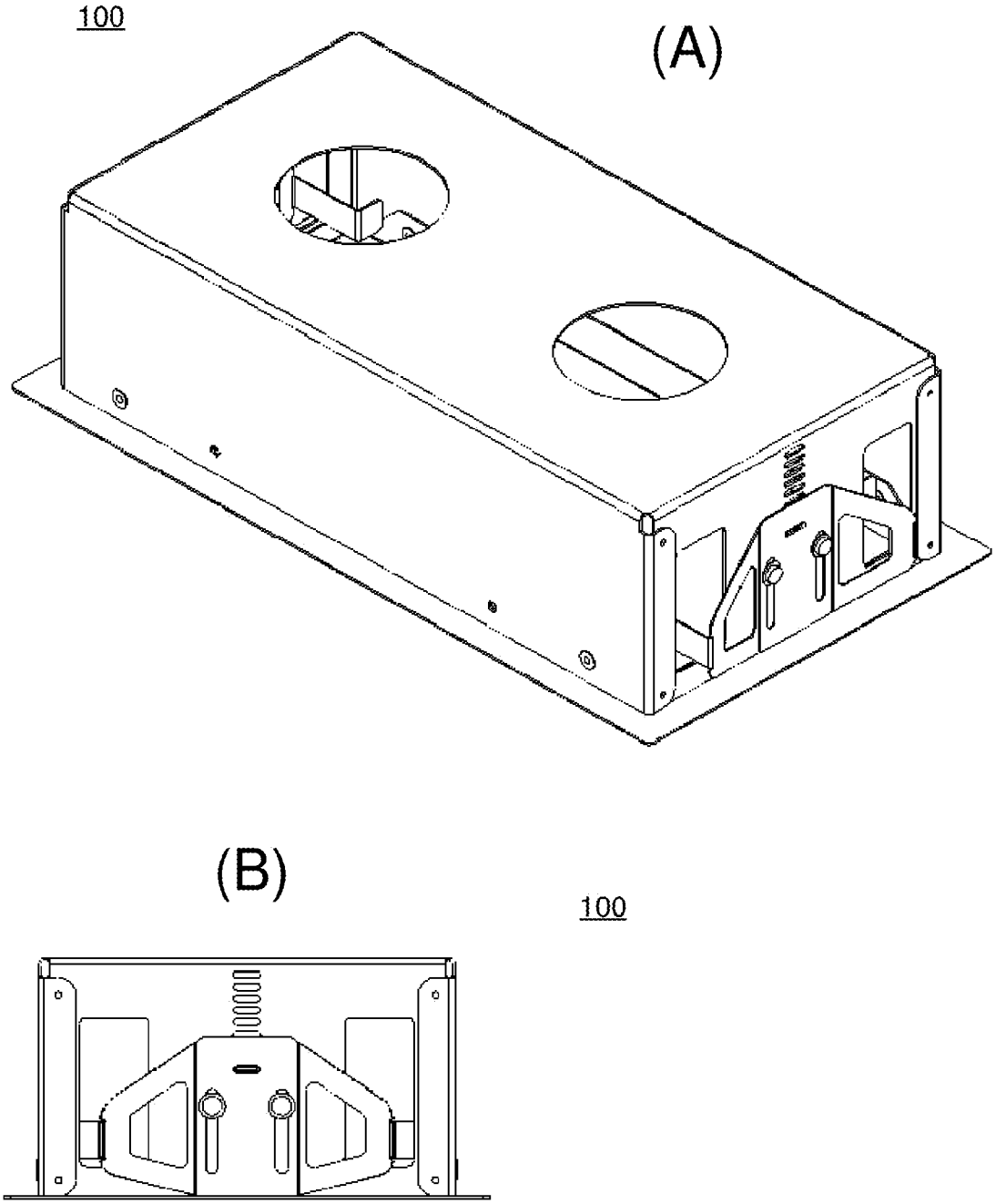
FIG. 2 shows various views of the housing of a downlight with an adjustable spring clipping device of FIG. 1A.

FIG. 2 shows various views of the housing of a downlight with an adjustable spring clipping device of FIG. 1A. More specifically, FIG. 2 includes a perspective view (A) and a side view (B) of the housing 100.

Figure 3:
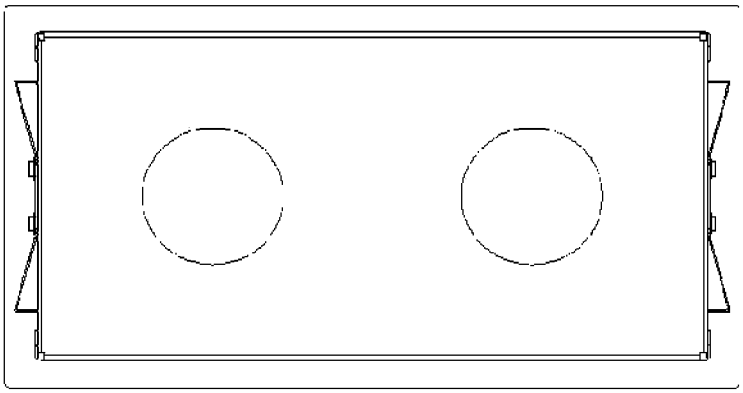
FIG. 3 shows various additional views of the housing of a downlight with an adjustable spring clipping device of FIG. 1A.
Figure 3:
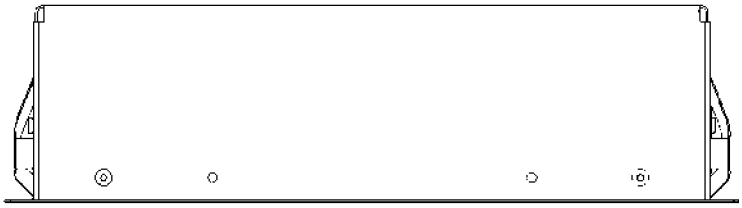
Figure 3:
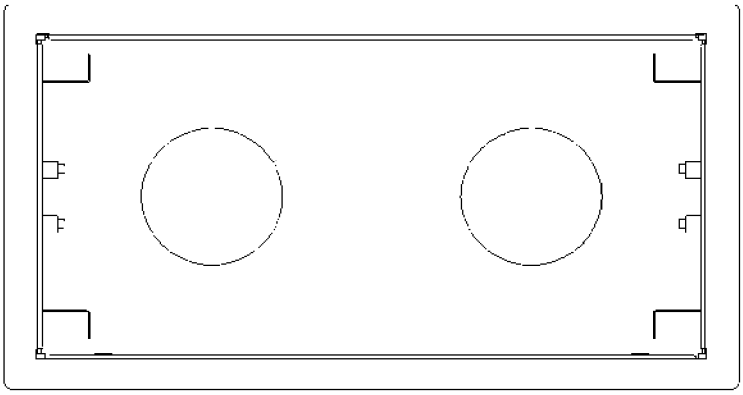

FIG. 3 shows various additional views of the housing of a downlight with an adjustable spring clipping device of FIG. 1A. More specifically, FIG. 3 includes a top view (A), a front view (B) and a bottom view (C) of the housing 100.

Figure 4:
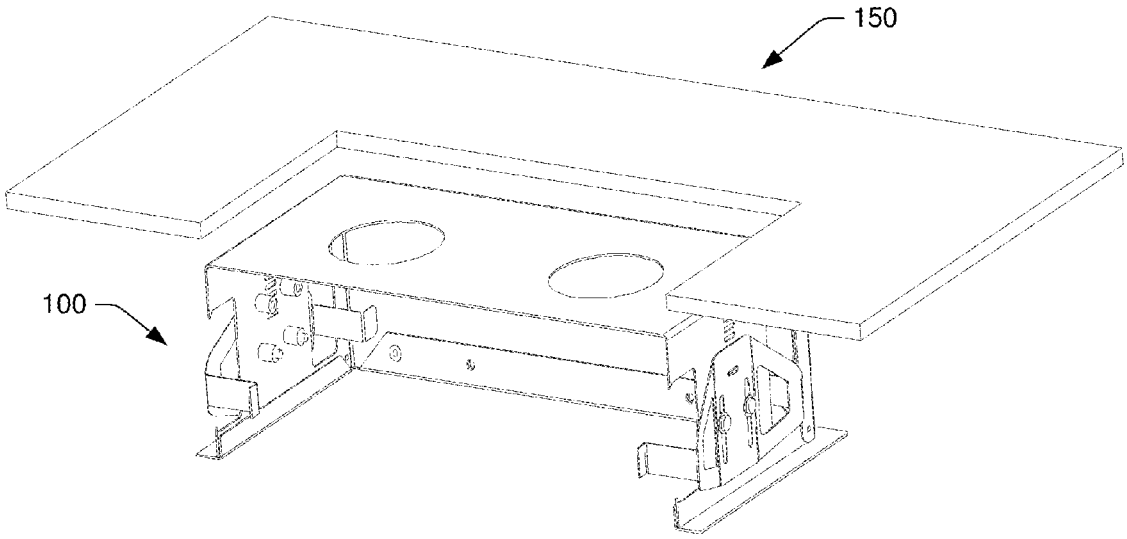
FIG. 4 is a cross-sectional perspective view of a housing of a downlight with an adjustable spring clipping device prior to installation in accordance with an embodiment of the present invention.
Figure 5:
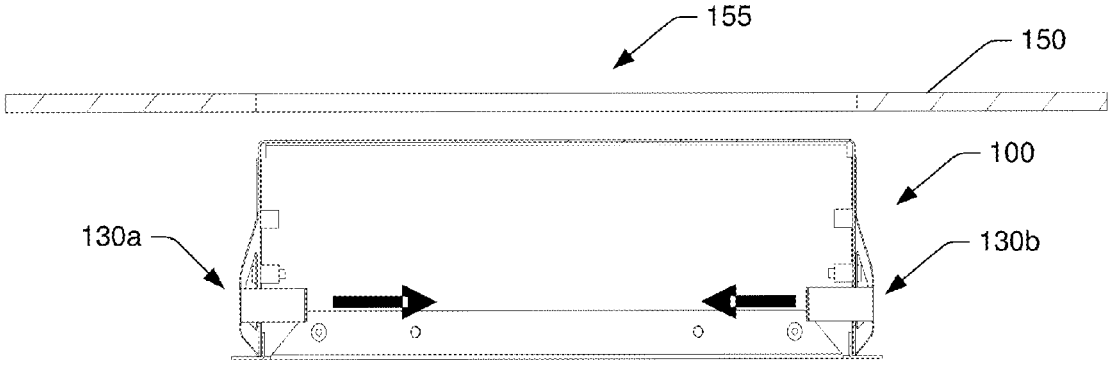
FIG. 5 is a cross-sectional side view of a housing of a downlight with an adjustable spring clipping device prior to installation in accordance with an embodiment of the present invention.
Figure 6:
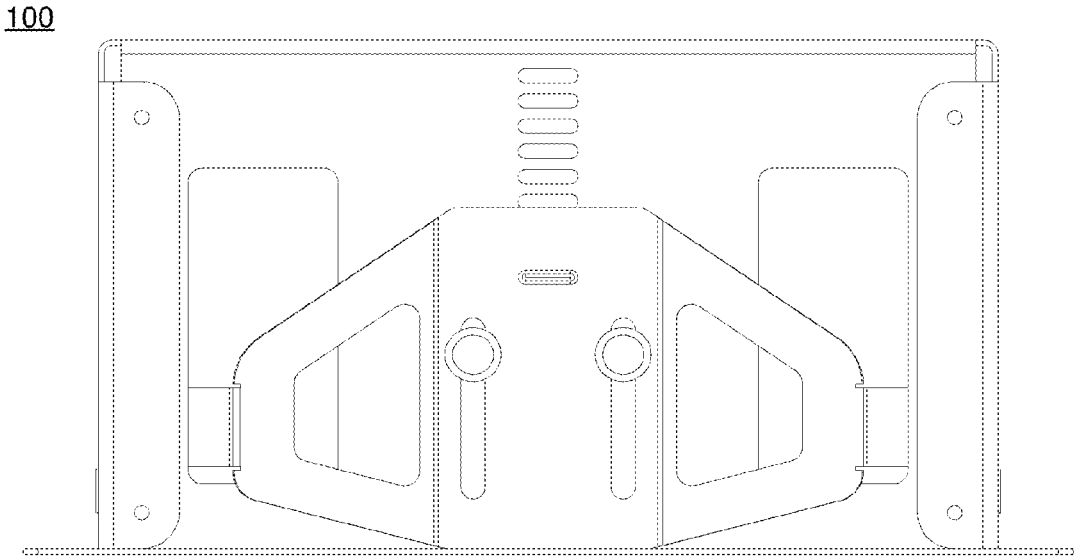
FIG. 6 shows a spring holder of an adjustable spring clipping device at a first height with respect to a housing of a downlight in accordance with an embodiment of the present invention.
Figure 7:
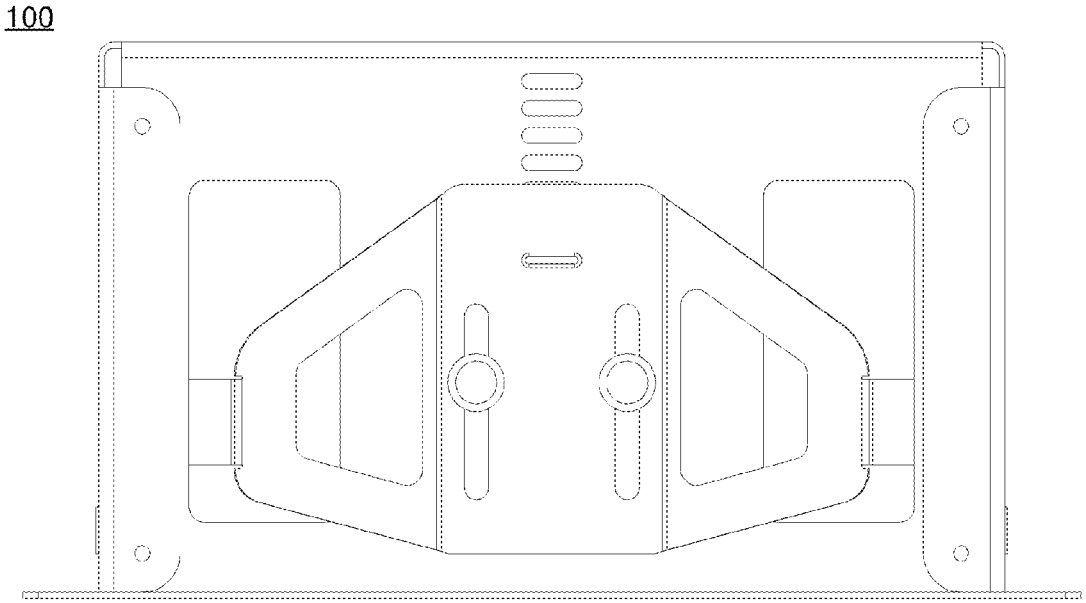
FIG. 7 shows a spring holder of an adjustable spring clipping device at a second height with respect to a housing of a downlight in accordance with an embodiment of the present invention.

A downlight with the housing 100 as described above provides several advantages. First, as shown in FIGS. 4 and 5, as the first and second spring clipping pieces 130*a*, 130*b* of the adjustable spring clipping device deform elastically when pulled inwardly with respect to the housing 100 (in the directions of the arrows shown in FIG. 5), installation and dismounting of the downlight are simplified. As shown in FIGS. 6 and 7, height of each of the first and second spring clipping pieces 130*a*, 130*b* of the adjustable spring clipping device can be adjusted to accommodate the thickness of the ceiling board. Once placed at a desired height, each of the first and second spring clipping pieces 130*a*, 130*b* is fastened to the upper cover 110 by the plurality of screws 135.

FIG. 4 is a cross-sectional perspective view of a housing of a downlight with an adjustable spring clipping device prior to installation in accordance with an embodiment of the present invention. For example, the housing shown in FIG. 4 may be the housing 100 of FIG. 1A and is to be installed into a ceiling board 150.

FIG. 5 is a cross-sectional side view of a housing of a downlight with an adjustable spring clipping device prior to installation in accordance with an embodiment of the present invention. For example, the housing shown in FIG. 5 may be the housing 100 of FIG. 1A. As shown in FIG. 5, the movable portions 132*a*, 132*b* of the first and second spring clipping pieces 130*a*, 130*b* of the housing 100 are pulled inwardly toward the center of the upper cover 100 so that the first and second spring clipping pieces 130*a*, 103*b* extend less or minimally from the exterior surface of the respective sidewall 110*a*, 110*b* of the upper cover 110. This allows the housing

100 to snugly slide in a cutout 155 on a ceiling board 150 for installation of the housing 100.

FIG. 6 shows a spring holder of an adjustable spring clipping device at a first height with respect to a housing of a downlight in accordance with an embodiment of the present invention. FIG. 7 shows a spring holder of an adjustable spring clipping device at a second height with respect to a housing of a downlight in accordance with an embodiment of the present invention. For example, the housing shown in FIGS. 6 and 7 may be the housing 100 of FIG. 1A. The height of each of the first and second spring clipping pieces 130*a*, 130*b* of the adjustable spring clipping device is adjustable to accommodate the thickness of the ceiling board. Once placed at a desired height, each of the first and second spring clipping pieces 130*a*, 130*b* is fastened to the upper cover 110 by the plurality of screws 135. This advantageously allows the housing 100 to be installed on ceiling boards of different thicknesses.

FIGS. 8-11 show installation procedure of a downlight with a housing having an adjustable spring clipping device in accordance with an embodiment of the present invention. For example, the housing shown in FIGS. 8-11 may be the housing 100 of FIG. 1A.

Figure 8:
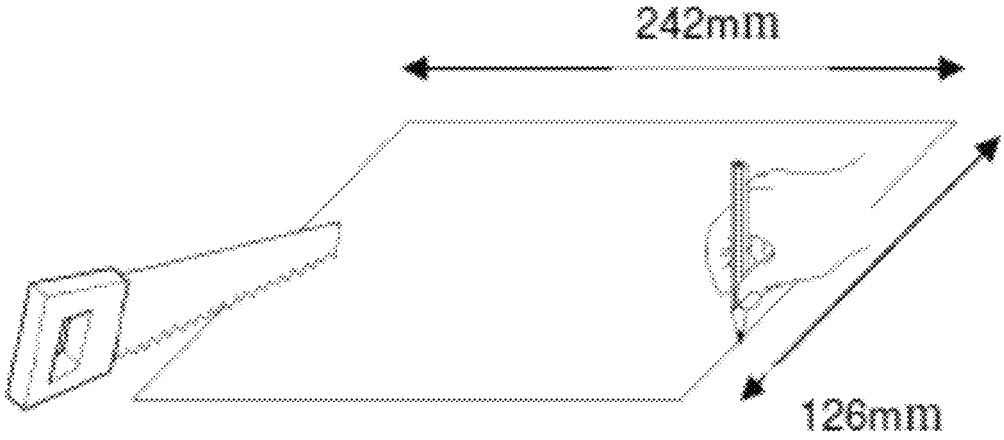
FIGS. 8-11 show an installation procedure of a downlight having a housing with an adjustable spring clipping device in accordance with an embodiment of the present invention.
Figure 9:
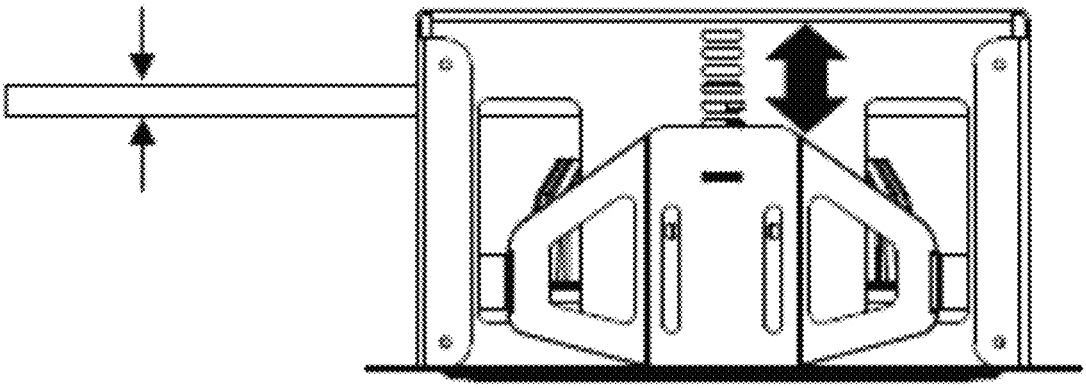
Figure 10:
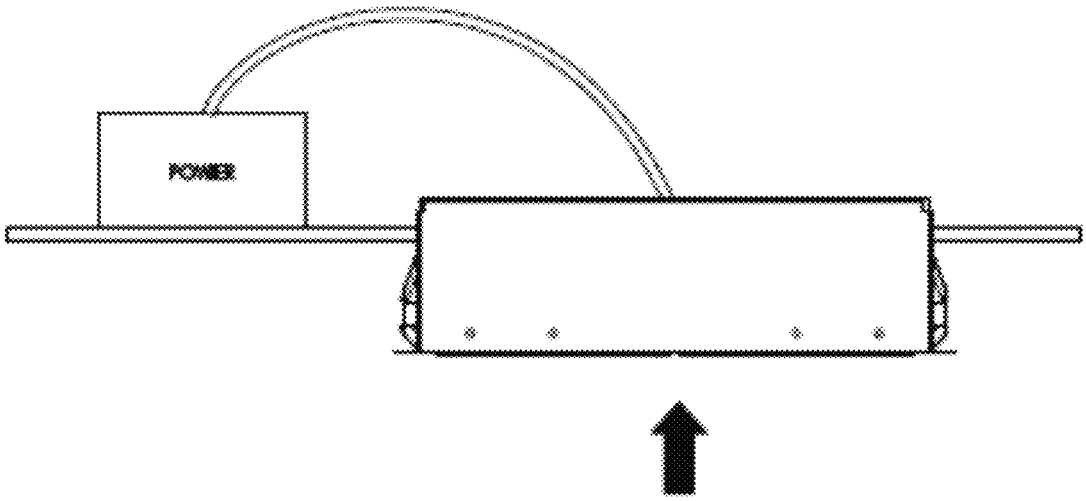
Figure 11:
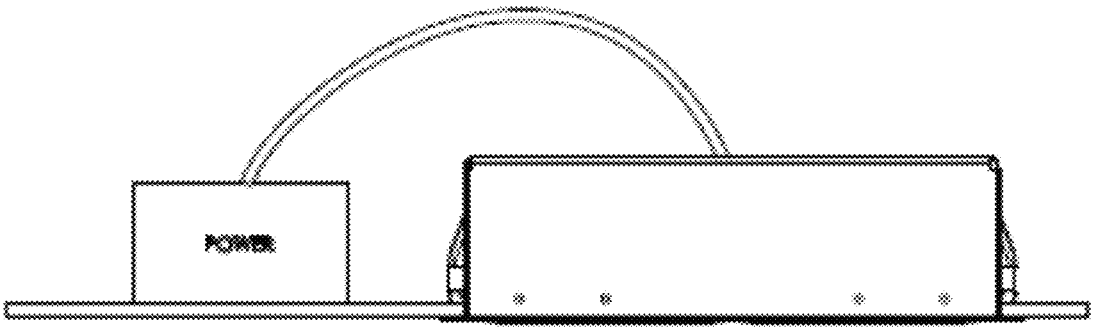

As shown in FIG. 8, a properly dimensioned cutout is provided at a location on the ceiling where a downlight described herein is to be installed. As shown in FIG. 9, the height of the spring clipping piece of the adjustable spring clipping device is adjusted according to the thickness of the ceiling board. As shown in FIG. 10, with a power unit of the downlight in place, the downlight is pushed into the cutout. The power unit supplies power to the one or more light sources of the downlight. As shown in FIG. 11, the downlight is placed and secured in position to complete the installation procedure.

Various embodiments of the housing 100 as described herein can be used in downlights having one or more light emitting diode (LED)-based light sources. Alternatively, a downlight in accordance with the present invention may include a non-LED light sources. For example, a light source of the downlight may include, for example, an incandescent light bulb, a halogen light bulb, a fluorescent light bulb, a mercury-vapor lamp, a sodium-vapor lamp, another type of a gas discharge lamp, etc.

Various embodiments of a downlight with an adjustable spring clipping device in accordance with the present invention are not limited to those described herein. The actual design and implementation of each component of the downlight or the adjustable spring clipping device in accordance with the present invention may vary from the embodiments described herein. Those ordinarily skilled in the art may make various deviations and improvements based on the disclosed embodiments, and such deviations and improvements are still within the scope of the present invention. Accordingly, the scope of protection of a patent issued from the present disclosure is determined by the claims as follows.

What is claimed is:

1. A housing of a downlight, comprising:

a first cover having a primary surface surrounded by a plurality of sidewalls forming a cavity therewithin that is configured to receive a light source, a first sidewall of the plurality of sidewalls having at least one opening, a second sidewall of the plurality of sidewalls having at least one opening;

a first spring clipping piece disposed on an exterior surface of the first sidewall of the first cover, the first spring clipping piece including at least one movable portion that traverses through the at least one opening of the first sidewall, the movable portion of the first spring clipping piece configured to be pulled inwardly with respect to the housing through the at least one opening of the first sidewall; and a second spring clipping piece disposed on an exterior surface of the second sidewall of the first cover, the second spring clipping piece including at least one movable portion that traverses through the at least one opening of the second sidewall, the movable portion of the second spring clipping piece configured to be pulled inwardly with respect to the housing through the at least one opening of the second sidewall.

2. The housing of a downlight of claim 1, wherein a height of the first spring clipping piece with respect to the primary surface of the first cover is adjustable.

3. The housing of a downlight of claim 2, wherein the first spring clipping piece is fastened to the first cover by at least one screw.

4. The housing of a downlight of claim 2, wherein a height of the second spring clipping piece with respect to the primary surface of the first cover is adjustable.

5. The housing of a downlight of claim 1, further comprising:

a second cover having an opening, the second cover mechanically coupled to the first cover.

* * * * *